United States Patent [19]

Takazawa

[11] 3,936,906

[45] Feb. 10, 1976

[54] CURTAIN STOPPING DEVICE

[76] Inventor: Ietsugu Takazawa,
Bancho-Chidorigabu-chi Habitation 901, 3 Sanban-cho, Chiyoda, Tokyo, Japan

[22] Filed: May 21, 1974

[21] Appl. No.: 471,918

[30] Foreign Application Priority Data

May 25, 1973 Japan ..... 48-59196

[52] U.S. Cl. ..... 16/87.4 R; 16/90; 188/42

[51] Int. Cl.[2] ..... A47H 5/032

[58] Field of Search ..... 16/87 R, 87.2, 99, 102, 16/87.6 R, 87.4 R, 90; 188/42, 166, 167; 160/19, 126, 33, 330, 333, 340, 341

[56] References Cited

UNITED STATES PATENTS

| | | | |
|---|---|---|---|
| 1,188,991 | 6/1916 | Putnam | 188/42 X |
| 1,431,921 | 10/1922 | Barnes | 188/42 |
| 1,846,537 | 2/1932 | Withrow | 188/42 |
| 2,834,435 | 5/1958 | Vanderbeck | 188/166 X |
| 3,585,674 | 6/1971 | Golden | 16/87.6 R |

*Primary Examiner*—George H. Krizmanich
*Attorney, Agent, or Firm*—Holman & Stern

[57] ABSTRACT

This invention is a curtain stopping device wherein a body is displacable on a curtain rail and is provided with a presser continuously urged toward the curtain rail so that the body can only be substantially moved by separating the presser from the curtain rail.

2 Claims, 3 Drawing Figures

PRIOR ART

CURTAIN STOPPING DEVICE

FIELD OF THE INVENTION

This invention relates to a curtain stopping device made to stop a curtain in any position.

BACKGROUND OF THE INVENTION

In the conventional case of closing curtains made and dividing a curtain texture by making them meet each other in the middle, they will not completely close in the middle and also, in the case of a curtain made of a sheet of a curtain texture to be opened or closed by being pulled to either end, they will not positively close at both ends or one end. Further, there are devices as shown in FIG. 3, where a stopper (18) provided with a magnet (19) in the end part which is fitted to an end part of the curtain material so that the curtains may be closed in the middle. However, such a device can not be used in the case of opening or closing the curtain only one side. In all the above described cases, the curtain will not be kept stopped in any position in the course of opening or closing it, and can be opened or closed under the influence of wind or the like which would be undesirable.

OBJECTS OF THE INVENTION

The present invention is made to eliminate such disadvantages and is to provide a stopping device which can stop a curtain in any opened or closed position through only the operation of a hanging string without being influenced by wind or the like.

An embodiment of the present invention shall be explained with reference to the drawings in which:

DESCRIPTION OF A PREFERRED EMBODIMENT

Figure 1:
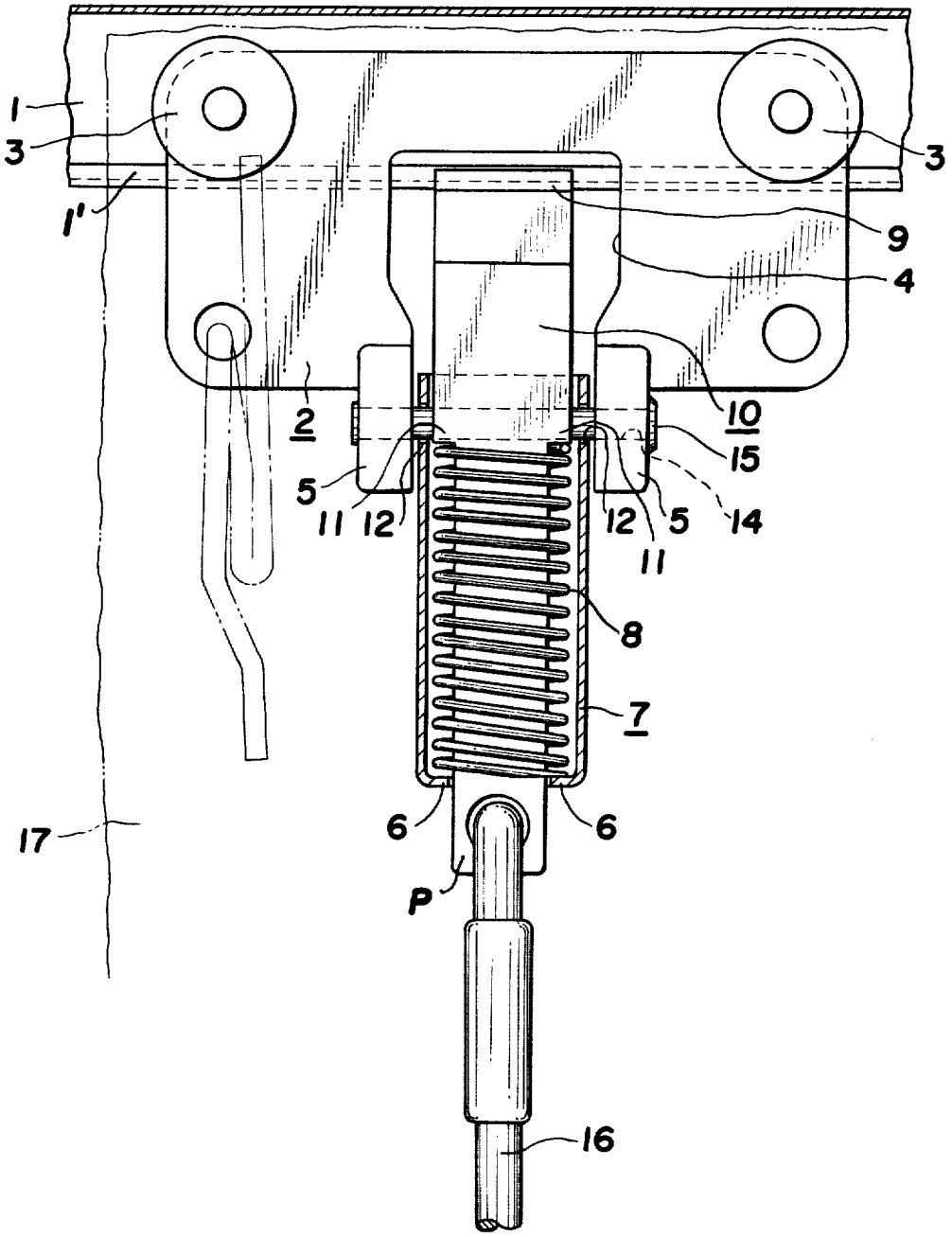
FIG. 1 is an elevation with portions broken away and sectioned.

A body (2) is displacably provided on a tubular curtain rail (1) having tracks 1'' flanking a slot 1' and wheels (3) are rotatably fitted to the tracks 1'' at opposite sides of the body (2) into running contact with the lower surfaces i.e., tracks inside the curtain rail (1). A cutout (4) in the lower portion of the body (2) is formed in the central part of the body (2) and projections (5) are provided to project respectively at both ends of the lower part of the cutout (4).

Figure 2:
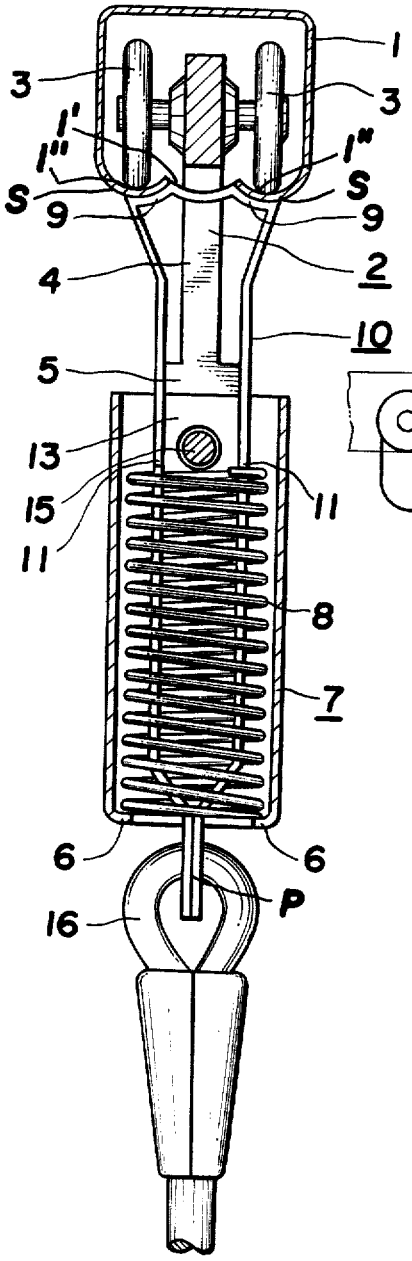
FIG. 2 is a vertically section of FIG. 1.
Figure 3:
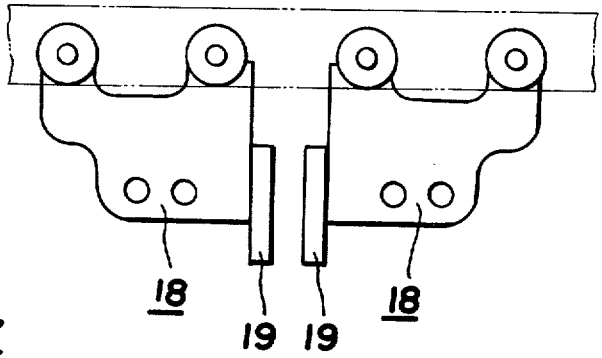
FIG. 3 is a diagramatic elevation of a conventional prior art stopper.

A brake assembly A comprises spring (8) which fits inside a tube (7) having a annular abutment portion (6) formed at the lower end and the spring is kept in contact at the lower end with the annular abutment (6). A presser (10), formed by bending a plate member, has braking or pressing contact portions (9) disposed in close contact, respectively with spaced lower surfaces S beneath the curtain rail (1), and presser 10 is fitted inside coil spring (8). Laterally projecting parts (11) are formed near a central portion of the presser (10) and contact the upper end of the coil spring (8). The upper part of the tube (7) is located between the opposed projections (5). A transverse retaining pin (15) extends through opposed holes (12) formed in the upper part of the tube (7) and a space (13) inside the presser (10) and at opposite ends into hole (14) in the projections (5) so that the tube (7) is anchored to the body (2) so that the braking or pressing contact parts (9) of the presser (10) will be continuously urged against the spaced lower surfaces S of the curtain rail (1); see FIG. 2.

Further, a hanging string (16) depends from the lower end P of the presser (10) and a curtain (17) (shown in phantom line) is fitted in the end part to the body (2).

OPERATION

When the hanging string (16) is pulled downward, the pressing contact parts (9) of the presser (10) will be separated from the lower surfaces S of the curtain rail (1) and the body (2) can be moved to open or close the curtain (17).

When the hanging string (16) is released, the presser (10) will be moved upward by the spring (8), the pressing contact parts (9) will press the lower surfaces outside the curtain rail (1) and the body (2) will be fixed to the curtain rail (1) and the curtain (17) will stop in any position.

In short, in the present invention, a body (2) movably provided on a curtain rail (1) is provided with a presser (10) always pressing the curtain rail (1) so that the body (2) may be moved by separating the presser (10) from the curtain rail (1) and therefore the curtain may be stopped in any position and may not be opened or closed under the influence of wind or the like.

What is claimed is:

1. A curtain positioning assembly comprising in combination:

an elongated tubular rail for suspending draw curtains or the like, said rail including spaced longitudinal track portions flanking a longitudinal slot;

curtain hanger means mounted on said rail and movable therealong for opening or closing the curtains, the improvement in which said curtain hanger means comprises:

a plate member having upper roller means disposed within said rail and engaged on inner surface portions of said longitudinal track portion, said plate member having a portion depending through said longitudinal slot of said rail and means for suspending a curtain therefrom; and a brake assembly mounted on said plate portion depending through said rail slot, said brake assembly comprising a tubular sleeve anchored on said depending plate portion beneath said rail tracks, said tracks having lower surface portions for engagement with braking means, a braking member reciprocatingly disposed in said sleeve anchored on said plate member, said braking member being displacable relative to said rail and sleeve, spring means disposed in said sleeve in engagement with said braking member and constantly urging the braking member toward said rail, said braking member having braking portions constantly urged toward and engageable with the respective, spaced lower surfaces of said rail track, said braking member having a portion depending through said sleeve for connection to a tension-applying means for overcoming said spring means to permit the curtain hanger means to be readily moved longitudinally along said rail.

2. The structure as claimed in claim 1, in which said plate has a downwardly-opening cutout portion into which said braking member projects, said braking member comprising a transversely-slotted element having an upper transverse portion engaged beneath said rail tracks, the depending plate having lateral support portions flanking the path of movement of said braking member, a mounting pin extending transversely through said sleeve and braking member and being permanently anchored in said lateral support portions at respective opposite ends of said mounting pin.

* * * * *